US005988629A

United States Patent [19]

Burlew et al.

[11] Patent Number: 5,988,629

[45] **Date of Patent: *Nov. 23, 1999**

[54] CONTROL FOR A SHEET STACK SUPPORTING PLATFORM

[75] Inventors: Leroy E. Burlew, Williamson; Michael T. Dobbertin, Honeoye; Henry P. Mitchell, Webster; Theophilus C. Wituszynski, Fairport, all of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/720,481

[22] Filed: Sep. 30, 1996

[51] Int. Cl.[6] ..... B65H 3/14; B65H 1/18; B65H 1/16; B65H 7/12

[52] U.S. Cl. ..... 271/152; 271/98; 271/153; 271/154; 271/263

[58] Field of Search ..... 271/98, 31, 30.1, 271/153, 152, 154, 155, 263

[56] References Cited

U.S. PATENT DOCUMENTS

| | | | |
|---|---|---|---|
| 3,955,811 | 5/1976 | Gibson | 271/9 |
| 5,017,972 | 5/1991 | Daughton et al. | 355/321 |
| 5,033,731 | 7/1991 | Looney | 271/176 |
| 5,090,676 | 2/1992 | Matsuno et al. | 271/94 |
| 5,295,678 | 3/1994 | Lindner et al. | 271/154 |
| 5,344,133 | 9/1994 | Jantsch et al. | 271/98 |
| 5,447,240 | 9/1995 | Makino | 271/263 |
| 5,584,472 | 12/1996 | Hidding et al. | 271/263 |
| 5,673,907 | 10/1997 | Rumsey et al. | 271/263 |

*Primary Examiner*—William E. Terrell
*Assistant Examiner*—Wonki K. Park
*Attorney, Agent, or Firm*—Lawrence P. Kessler

[57] ABSTRACT

A sheet feeder having a platform for supporting a stack of sheets, a feed head assembly for feeding sheets seriatim from the top of a sheet supply stack on the platform, a mechanism for moving the platform relative to the feed head assembly, and a device for controlling operation of the platform moving mechanism. The control device for the platform moving mechanism includes a sensor for detecting marginal edges of sheets in the sheet stack on the platform, and producing a signal indicative of sheet edge detection. Additionally, a sensor is provided for detecting the location of the topmost sheet on the sheet stack on the platform, and producing a signal indicative of such top sheet location detection. A signal is set representative of the top of the sheet stack being in proper operative relation to the feed head assembly, this set signal being based on the signal from the top location sensor for the particular location of the top of the stack when the marginal sheet edge detection signal is first produced. Periodically thereafter, a control signal is produced for actuating the sheet stack supporting platform moving mechanism until the signal indicative of detection of the topmost sheet from the top location sensor is substantially equal to the set signal.

24 Claims, 6 Drawing Sheets

CONTROL FOR A SHEET STACK SUPPORTING PLATFORM

BACKGROUND OF THE INVENTION

The present invention relates in general to supporting platforms for sheet stacks for reproduction apparatus, and more particularly to a control for the sheet stack supporting platform of a reproduction apparatus which accommodates for variations in sheet evenness (flatness) to maintain the topmost sheet in a sheet stack in proper relation with a sheet feed head assembly.

In typical reproduction apparatus such as copiers or printers, for example, information is reproduced on individual cut sheets of receiver material such as plain bond paper or transparencies. Receiver sheets, of the various types, are stored in stacks and respectively fed seriatim from such stacks when copies are to be reproduced thereon. The sheet feeder for the reproduction apparatus must be able to handle a wide range of sheet types and sizes reliably and without damage. Sheets must be accurately fed individually from the sheet stack; that is, without misfeeds or multifeeds.

A recently described highly efficient and reliable sheet feeder is shown in U.S. Pat. No. 5,344,133, issued Sep. 6, 1994, in the name of Jantsch et al. In such apparatus, a stack of sheets is stored in a supply hopper. A sheet feed head assembly, including a plenum, a vacuum source in flow communication with the plenum, and a mechanism, such as a feed belt associated with the plenum, urges a sheet acquired by vacuum in a sheet feeding direction away from the sheet supply stack. The sheet supply stack is supported so as to maintain the topmost sheet in such stack at a predetermined level in spaced relation with respect to the urging mechanism of the sheet feed head assembly. A first positive air supply directs a flow of air at the sheet supply stack to levitate the top several sheets in the supply stack to an elevation enabling the topmost sheet to be acquired by vacuum from the sheet feed head assembly plenum; and a second positive air supply directs a flow of air at an acquired sheet to assure separation of any additional sheets adhering to such topmost sheet.

It is clear that the sheet stack must be accurately maintained in operative relation with the sheet feed head assembly to assure the desired sheet feeding, in proper timing, from the stack. In the aforementioned sheet feeder, a stack height sensor monitors the location of the topmost sheet in the stack. A drive for the stack supporting platform drive then maintains that topmost sheet within an operating window relative to the sheet feed head assembly. However, the air flow for sheet separation causes the lead edge of the sheets in the stack on the supporting platform to fluff during sheet feeding. The fluffing action causes the stack height sensor to indicate that the topmost sheet in the stack is at the proper elevation relative to the feed head assembly, even when advance of the stack supporting platform is required to maintain the top of the stack at the proper feeding location. Moreover, any unevenness (i.e., lack of flatness) in the sheets of the stack, such as sheet curl for example, has an adverse effect on the ability to properly locate the top of the stack relative to the sheet feed head assembly. This is due to the fact that the unevenness alters the actual location of the top sheet relative to the sheet feed head assembly when such sheet is first detected by the height sensor.

SUMMARY OF THE INVENTION

In view of the foregoing discussion, this invention is directed to a sheet feeder having a platform for supporting a stack of sheets, a feed head assembly for feeding sheets seriatim from the top of a sheet supply stack on the platform, a mechanism for moving the platform relative to the feed head assembly, and a device for controlling operation of the platform moving mechanism. The control device for the platform moving mechanism includes a sensor for detecting the marginal edges of sheets in the sheet stack on the platform for determining unevenness in such marginal edges, and producing a signal indicating sheet edge detection. Additionally, a sensor is provided for detecting the location of the topmost sheet on the sheet stack on the platform, and producing a signal indicative thereof. A signal is set representative of the top of the sheet stack being in proper operative relation to the feed head assembly, this set signal being based on the signal from the top location sensor for the particular location of the top of the stack when the marginal sheet edge detection signal is first produced. Thereafter, at appropriate times, a control signal is produced for actuating the sheet stack supporting platform moving mechanism until the signal indicative of detection of the topmost sheet from the top location sensor is substantially equal to the set signal.

The invention, and its objects and advantages, will become more apparent in the detailed description of the preferred embodiment presented below.

BRIEF DESCRIPTION OF THE DRAWINGS

In the detailed description of the preferred embodiment of the invention presented below, reference is made to the accompanying drawings, in which.

DETAILED DESCRIPTION OF THE INVENTION

Figure 1:
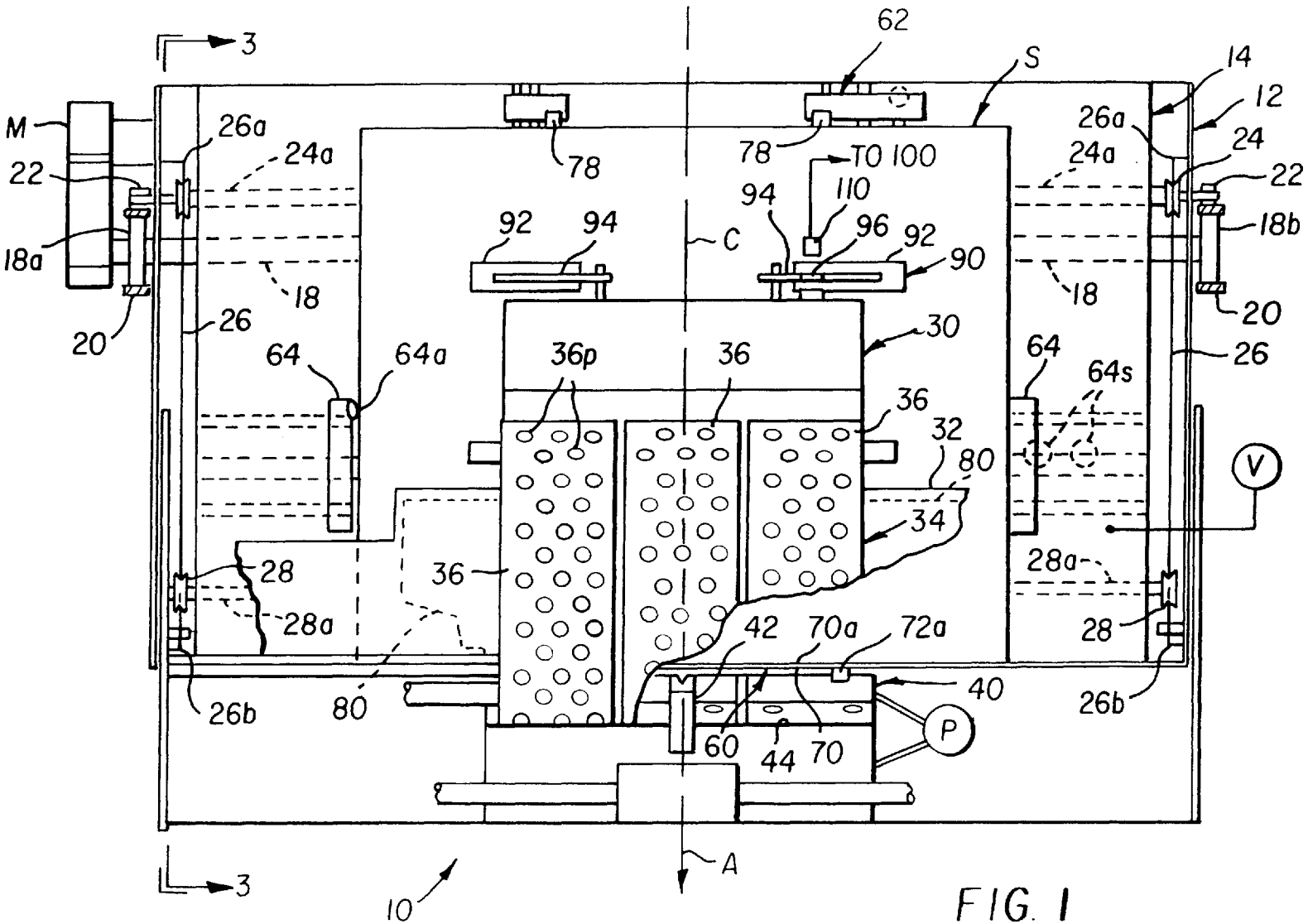
FIG. 1 is a top plan view of a top feed vacuum corrugated receiver sheet supply and feeding apparatus, including a mechanism for sensing sheet stack height and curl to accurately control sheet feed, according to this invention, with portions of such apparatus removed or broken away to facilitate viewing.
Figure 2:
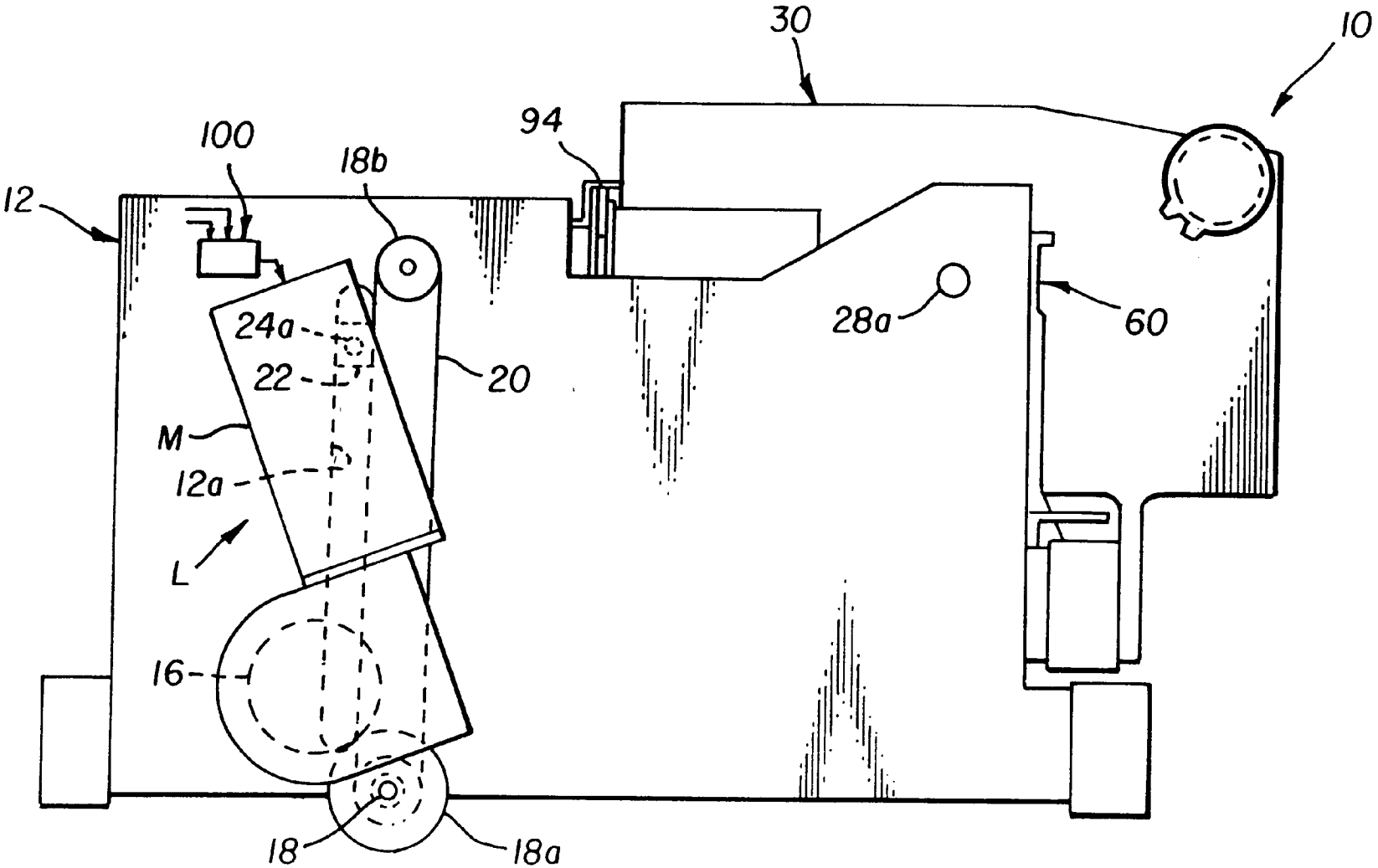
FIG. 2 is a side elevational view the top feed vacuum corrugated receiver sheet supply and feeding apparatus particularly showing the mechanism for moving the sheet stack supporting platform.
Figure 3:
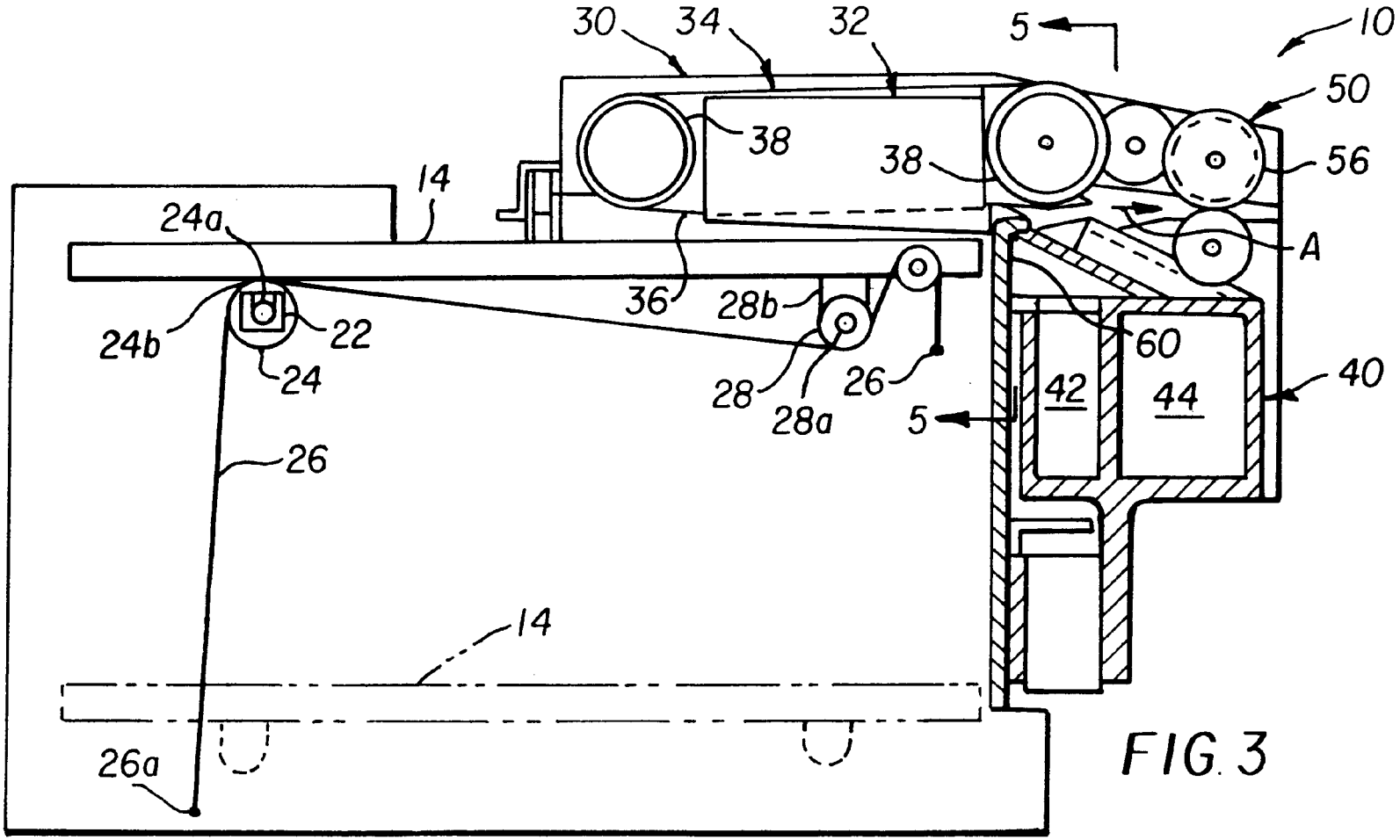
FIG. 3 is a side elevational view of a cross-section of the top feed vacuum corrugated receiver sheet supply and feeding apparatus of FIG. 1, taken along lines 3—3 of FIG. 1.

Referring now to the accompanying drawings, FIGS. 1, 2, and 3 generally show an exemplary top feed vacuum corrugated receiver sheet supply and feeding apparatus such as that disclosed in the aforementioned U.S. Pat. No. 5,344, 133, for use with a reproduction apparatus of any well known type. Such top feed vacuum corrugated receiver sheet supply and feeding apparatus, designated generally by the numeral 10, is described herein only in such sufficient detail, and with appropriate modifications as are necessary to enable a full and complete understanding of the instant invention. The top feed vacuum corrugated receiver sheet supply and feeding apparatus 10 incorporates an open hopper 12 and an elevating platform 14 for supporting a stack of sheets. A sheet stack (designated by the letter S) supported on the platform 14 contains individual sheets suitable for serving as receiver sheets having reproductions formed thereon in a reproduction apparatus such as a copier or printer for example, or for separating or providing divisions in a copy set.

Sheets in the stack S may be selected from a wide variety of materials and sizes depending upon the desired end use. The sheet stack supporting platform 14 is supported within the hopper 12 for substantially vertical elevational movement by a suitable lifting mechanism L (see FIGS. 1 and 2). The lifting mechanism L serves to raise the platform 14 to an elevation for maintaining the topmost sheet in the stack S at a predetermined level during operation of the apparatus 10, and lower the platform to permit adding sheets thereto. The lifting mechanism L includes a motor M, attached to the outside of the upstanding front wall of the hopper 12. The motor M rotates and output gear 16 in mesh with a gear 18*a* mounted on a shaft 18 extending from the upstanding front wall of the hopper 12 through the upstanding rear wall of the hopper. A pair of pulley mounted lifting chains 20 are respectively interconnected through gears 18*b* with the shaft 18 to be moved about a closed loop path when the shaft 18 is rotated by the motor M.

Each of the lifting chains has a link 22 extending through slots 12*a* respectively in the front and rear upstanding walls of the hopper 12. The links 22 are connected to respective pulleys 24 mounted on a shaft 24*a* supported in brackets 24*b* (see FIG. 3) extending from the underside of the platform 14. Tension cables 26 are respectively connected, at the ends 26*a*, 26*b* thereof, to the front and rear upstanding wall of the hopper 12. The cables are respectively threaded over their associated pulleys 24 and under pulleys 28 mounted on a shaft 28*a* supported in brackets 28*b* (see FIG. 3) extending from the underside of the platform 14.

In FIG. 3, the sheet stack supporting platform 14 is shown in its most elevated position in solid lines, and in its lowest position in phantom. During the operation of the lifting mechanism L, an appropriate signal to the motor M causes the motor to rotate the gear 16, either clockwise (in FIG. 2) to lower the platform 14 toward the lowest position or counterclockwise to raise the platform toward its most elevated position. Rotation of the gear 16 moves the lifting chains 20 in their closed loop paths imparting vertical movement to the links 22. This movement, in turn, moves the shaft 24*a*, and thus the platform 14 and its brackets 24*b* and pulleys 24. The platform 14 is maintained substantially level in its movement by the action of the tension cables 26 which cooperatively move the pulleys 28 and thus the shaft 28*a* and brackets 28*b* of the platform. Of course, other precisely actuatable lifting mechanisms, such as worm gears or scissors linkages, are suitable for use in elevation control for the sheet stack supporting platform according to this invention. The drive for the motor M to maintain the topmost sheet in the stack S supported on the platform 14 at the predetermined level (or to lower the platform) is accomplished by a control mechanism 100, according to this invention. The control mechanism 100 regulates operation of the motor M for actuating the lifting mechanism L, in the manner to be explained hereinbelow, to selectively raise the platform 14 through a predetermined increment or lower the platform.

A sheet feed head assembly, generally designated by the numeral 30, is located in association with the hopper 12 so as to extend over a portion of the platform 14 in spaced relation to a sheet stack supported thereon. The sheet feed head assembly 30 includes a ported plenum 32 connected to a vacuum source V, and an air jet device 40 connected to a positive pressure air source P. A positive pressure air jet from the device 40 levitates the top sheets in the supported sheet stack S, while vacuum at the plenum 32 is effective through to cause the topmost levitated sheet from the stack to thereafter be acquired at the plenum for separation from the sheet stack. Additional positive pressure air jets from the device 40 assure separation of subsequent sheets from the acquired topmost sheet.

Figure 5:
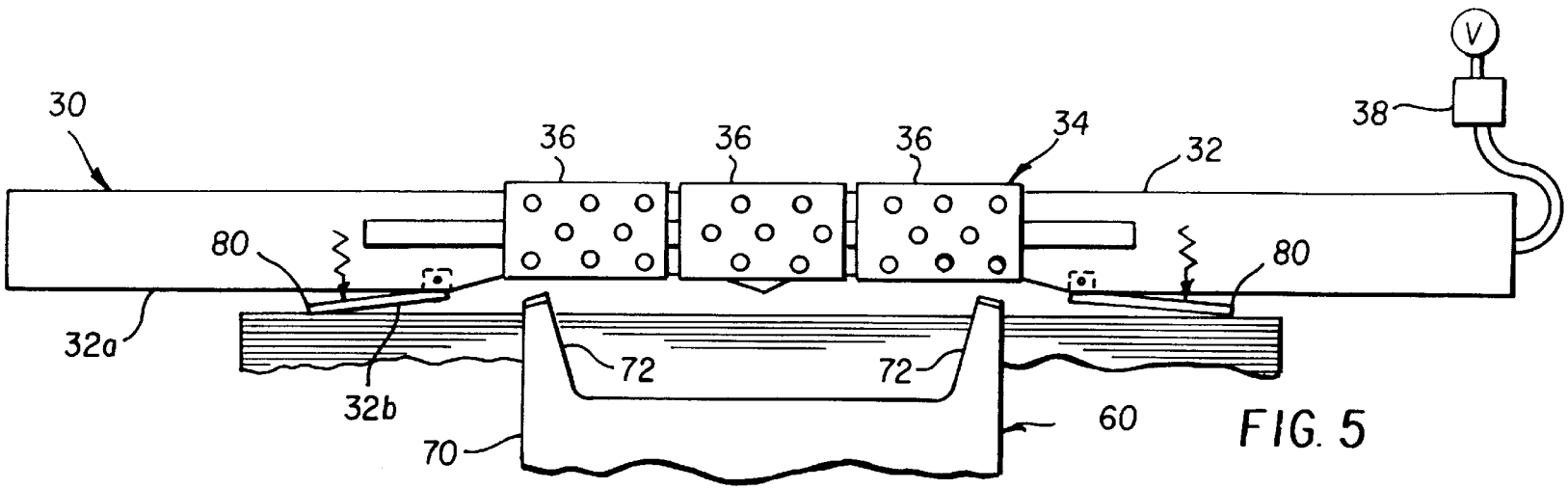
FIG. 5 is an end view, on an enlarged scale and with portions removed, of a portion of the receiver sheet supply and feeding apparatus, particularly showing the feed head assembly thereof including the marginal edge sensors, taken along the lines 5—5 of FIG. 3.

The lower surface 32*a* of the plenum 32 of the sheet feed head assembly 30 has a particularly configured shape (shown in FIG. 5) so as to provide for corrugation of an acquired sheet. Such lower surfaces of the plenum respectively include spring-urged plates 80 pivotably connected to the plenum. The plates 80 serve a dual function; that is, the plates (1) act on the sheet stack in a manner to increase the reliability of feeding of a wide range of sheet types, and (2) enable detection of the marginal edges of the sheet stack, for the purpose to be explained below.

With regard to the action of the plates 80 on the opposed marginal edges of the sheet stack S, as the top sheets in the supported sheet stack are levitated, the topmost sheet contacts the plates. An optimal pressure is exerted on the opposed marginal edges of the sheet parallel to the feed direction indicated by the arrow A (cross-track edges) by the plates 80 to help in forming a controlled corrugation to the sheet. The shape (location) of the plates 80 and the force which they exert on the sheet stack by the spring-urging is preselected to ensure reliable feeding for a wide range of sheet size and types. The pressure on the sheet stack by the plates is in the range which is sufficient to prevent uncontrolled lifting of the marginal edges from the remainder of the sheets in the stack, but less than an amount which would result in significant pinching of the sheets which may cause misfeeding or skewing of fed sheets. Similarly, the plates are shaped to assume a location (see FIG. 1) relative to the air jet device 40 in a spaced range sufficient to prevent misfeeds and/or uncontrolled lifting of the opposed marginal edges. The pressure exerted on the sheet stack by the plates 80, and their location, are selected such that the plates do not unduly inhibit the levitating air stream from passing through the sheet stack and out the rear thereof, as discussed below.

The controlled corrugation of the sheet establishes a consistent spacing for the center portion of the sheet from the center portion of the plenum 32. As such, the access time for a sheet to be acquired at the plenum is repeatably consistent and readily predictable. The interactions of the plenum 32, the air jet device 40, and a front stop (designated by the numeral 60) assure that control over the sheet as it is acquired at the plenum is never lost. Further, corrugation of the sheet contorts the sheet in an unnatural manner. Since subsequent sheets are not subjected to the same forces, at the same time, as is the topmost sheet, such subsequent sheets are unable to contort in the same manner. Accordingly, the subsequent sheets are effectively separated from the topmost sheet as it is being acquired at the plenum.

The sheet feed head assembly 30 additionally includes a belt mechanism 34 for transporting an acquired sheet in a feed direction (designated by the arrow A in FIGS. 1 and 3) away from the sheet stack S toward a downstream location. The belt transport mechanism 34 has a plurality of belts 36 entrained about rollers 38 to establish a closed loop path about the plenum 32. The lower runs of the belts 36 are in intimate contact with the lower surface 32*a* of the plenum 32 (see FIG. 5). The acquired sheet from the sheet stack S is effectively tacked to the belts by air pressure resulting from the application of vacuum in the plenum 32 through the plenum ports 32*p* and the belt ports 36*p*. The acquisition of the sheet is aided by the plates 80 which increase the impedance to air flow above the top of the sheet stack S into the vacuum plenum 32, and thus improve the efficiency of the vacuum action in acquiring the topmost sheet.

The belts 36 are selectively driven in a direction (counterclockwise in FIG. 3) to remove the acquired sheet from the area above the sheet stack S and transport the sheet in the feed direction A along a travel path to a downstream transport, such as driven feed nip roller pair 50. Accordingly, the belts 36 are selectively driven so as to feed an acquired sheet such that the acquired sheet is transported from the sheet stack S and is thereafter available for any further processing, such as receiving a reproduction from a copier or printer, for example.

The hopper 12 incorporates a front stop 60, a rear stop 62 and side stops 64 arranged to engage the marginal edges of a sheet stack S supported on the platform 14 and accurately locate the sheet stack in register relative to the sheet feed head assembly 30. The front stop 60 additionally provides a lead edge guide for the topmost sheet in the sheet stack as it is removed from the stack for acquisition, and also serves as a retard mechanism for any sheets adhering to the topmost sheet as it is removed. The positive pressure air jet device 40 of the sheet feed head assembly 30 is located adjacent to the front stop 60 on the opposite side thereof from the sheet supporting platform 14. As noted above, the air jet device 40 is for the purpose of levitating the top sheets in the sheet stack S and separating subsequent sheets adhering to the topmost sheet when acquired for removal from the sheet stack.

The positive pressure air jet device 40 includes a first air jet arrangement 42 and a second air jet arrangement 44. The first air jet arrangement 42 incorporates a single nozzle 42*a* in flow communication with a source of positive pressure air P. The nozzle 42*a* is located substantially along the center line C (see FIG. 1) of the sheet stack S, in the cross-track direction, and is aimed at the location where the top of the sheet stack will be positioned by the sheet support platform 14. The single nozzle 42*a* directs a high pressure air stream at the sheet stack, in the center of the lead edge, to fluff the top several sheets in the stack to bring the topmost sheet into association with the sheet feed head assembly 30 where it can be acquired, by vacuum, at the plenum 32.

The top sheets in the sheet stack S begin separation between each sheet and the topmost sheet rises, along its center line C, to a controlled height above the sheet stack. Once the sheets have started to levitate (fluff up) in the center, the topmost sheet will engage the plates 80 and the opposed marginal edges will lift the plates. Such lifting action continues until the down forces due to the plates (i.e., the weight and spring urging for the plates) are balanced by the up forces due to the air stream. The compliance of the spring-urged plates when engaged by the sheets enables a limited amount of overtravel of the platform 14. The air flow going into the stack will ideally be allowed to proceed through the stack out the rear thereof, with some finding its way out through the sides of the stack.

Figure 4:
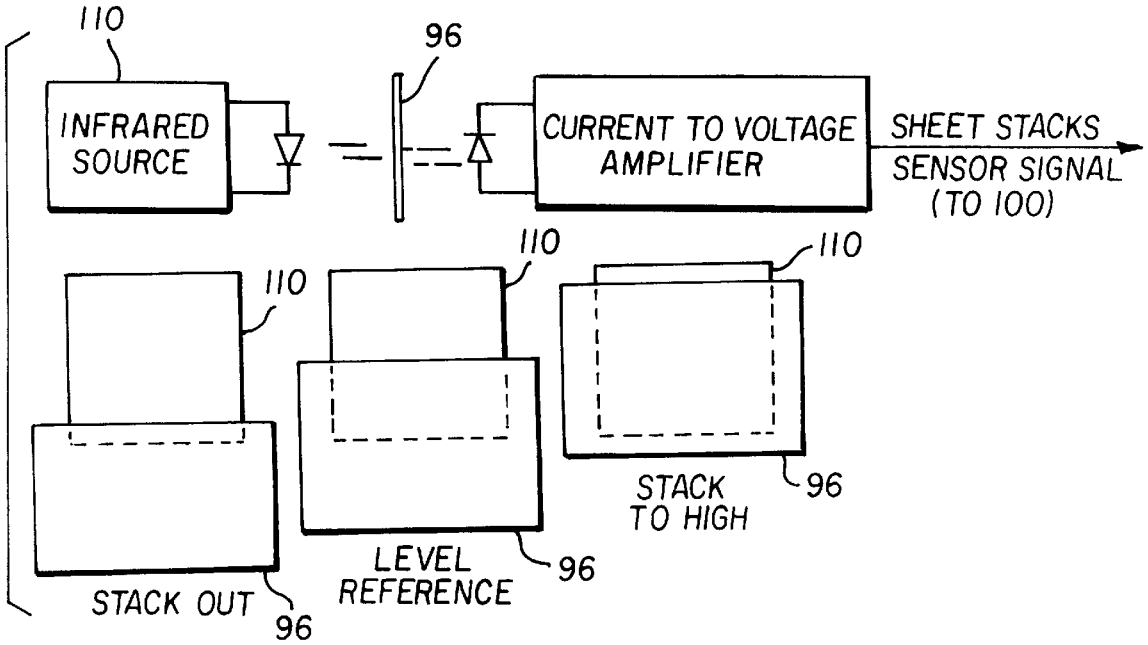
FIG. 4 is a schematic view of the sheet stack supporting platform control circuit.

The second air jet arrangement 44 incorporates a plurality of nozzles 44*a* (preferably six in number) in common flow communication with the source of positive pressure air P (or, alternatively, a second separate source of pressurized air). The nozzles 44*a* are aimed at the location where the top of the sheet stack will be positioned by the sheet support platform 14, and slightly downstream of the aim point for the first air jet nozzle 42*a* (see FIG. 4). The purpose of the second air jet arrangement 44 is to separate any sheets adhering to the topmost sheet acquired by the sheet feed head assembly 30 for removal and transport from the sheet stack S.

As noted above, the hopper 12 also incorporates a rear stop 62. The rear stop 62 is necessary to prevent sheets levitated from the sheet stack S by the first air jet arrangement 42 from moving toward the rear (relative to the sheet stack) by the positive air pressure exerted on the sheets. The rear stop 62 is adjustably mounted (on guide rods for example) for selective positioning in the sheet feed direction A so as to positively engage the rear edge of a sheet stack, of any of a variety of dimensions in the sheet feed direction, supported on the platform 14 and engaged at its lead edge with the front stop 60. The rear stop 62 is manually movable along guide rods to a selected position corresponding to a dimension of the sheet stack in the in-track direction (measured from the front stop 60). If desired, the rear stop 62 may include a loading device 78, such as a leaf spring, for exerting pressure on the top portion of the sheet stack S (and the levitated sheets) to assure that the sheets are maintained in register against the front stop 60.

The levitated sheets are maintained by the rear stop in their position relative to the sheet stack against the front stop 60. However, it is important that the positive air flow from the air jet device 40 between the levitated sheets be allowed to escape from the rear of the sheets. If the air flow were to be restricted, the corrugation of the topmost sheet will become unpredictable and thus the efficiency in acquiring the sheet by the sheet feed head assembly 30 will be substantially reduced. Accordingly, the rear stop 62 is formed as two substantially identical assemblies spaced apart on opposite sides of the supported sheet stack center line C. Of course, a single assembly with a large opening spanning the area through which the air flow can pass substantially unrestricted is also suitable for use with the apparatus 10.

Figure 7:
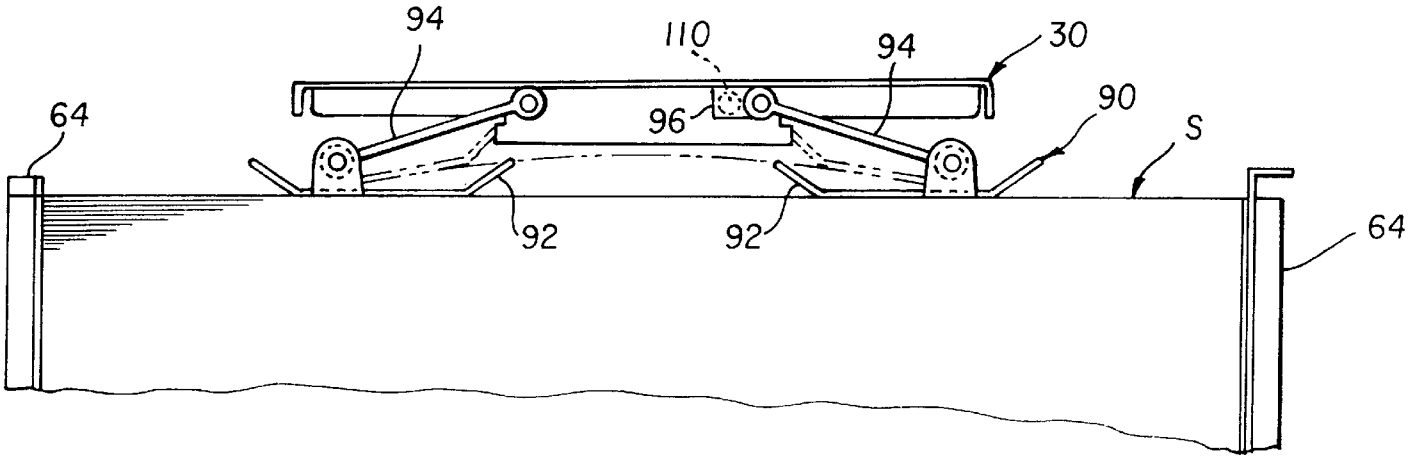
FIG. 7 is a rear elevational view of the apparatus shown in FIG. 6.

A device 90 (such as described in the provisional U.S. patent application Ser. No. 60/002,109) is provided for facilitating handling sheets with the sheet supply and feeding apparatus 10 described above. The apparatus 90 (best seen in FIGS. 1, 6, and 7) includes a pair of weighted members 92*a*, 92*b* adapted to rest on the top of the sheet supply stack S supported on the platform 14. The weighted members 92*a*, 92*b*, configured generally in the shape of skis, are respectively connected by arms 94 to the feed head assembly 30 at the rear portion thereof. The respective arms 94 are pivotably connected at one end to the feed head assembly 30 and at the other end to a weighted member. As such, the weighted members 92*a*, 92*b* respectively extend from the feed head assembly 30 and readily follow the top of the sheet supply stack S as the topmost sheet is acquired by the feed head assembly. Specifically, FIG. 7 shows the sheet supply stack S with the weighted members 92*a*, 92*b* in engagement with the topmost sheet in solid lines before acquisition by the feed head assembly 30, and in phantom lines after the topmost sheet has been acquired by the feed head assembly.

Figure 6:
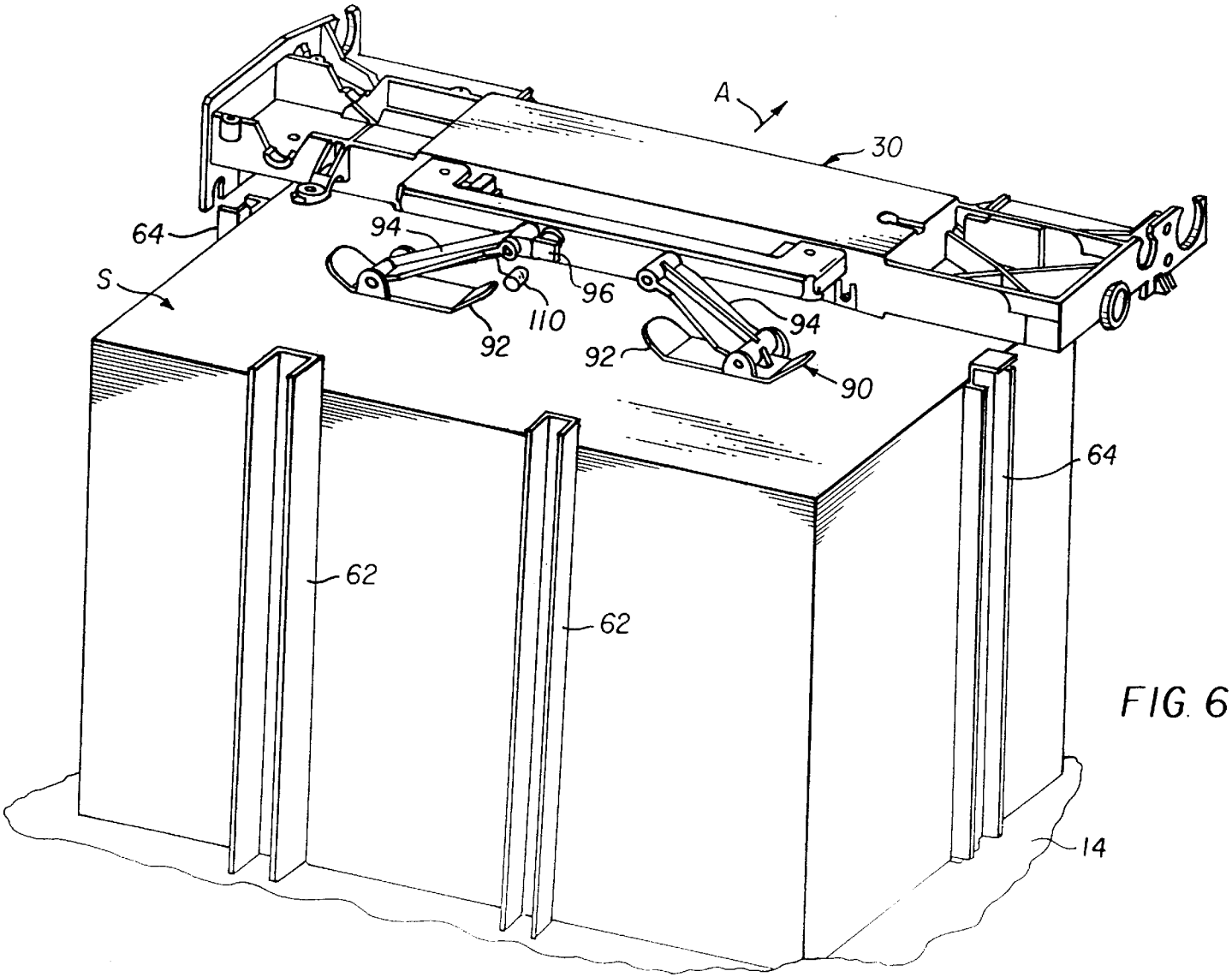
FIG. 6 is a view, in perspective, of the receiver sheet supply and feeding apparatus, particularly showing the sensor for detecting height of the sheet stack relative to the sheet feed head assembly, and the marginal edge sensors.

The location of the weighted members 92*a*, 92*b* is selected such that they respectively contact the sheet supply stack S upstream, in the direction of sheet feed (represented by the arrow A) from the sheet supply stack, of the feed head assembly 30 (see FIG. 6). The weighted members 92*a,* 92*b* apply a force to the sheet supply stack S, such force having at least a component in a direction relative to such sheet supply stack to prevent individual sheets (such as sheets of tab stock for example) in such stack from prematurely moving, out of registered control of the feed head assembly 30. That is to say, as explained above, the separating air jets of the pressurized air jet device 40 direct a positive flow of air at the top portion of the sheet supply stack S in a direction having a component opposite to the direction of sheet feed by the feed head assembly 30. Further, the rear marginal edge of the sheet supply stack S may not be completely restrained by the rear stop 62 due to the unevenness resulting, for example, from tab portions of individual sheets. Thus, when the topmost sheet is acquired by the feed head assembly 30, individual sheets beneath the topmost sheet will be urged by the positive air flow in the direction opposite the feed direction. Accordingly, the weighted members 92*a,* 92*b* are arranged to prevent such sheets from moving, out of the proper area for later registered acquisition by the feed head assembly which otherwise may lead to failure to subsequently acquire such sheets, or in misregistration of acquired sheets.

The weighted members 92*a,* 92*b* are arranged to act on the sheet supply stack S to maintain the individual top sheets, below the acquired sheet, in frictional engagement, at least over a portion thereof. As such, the weighted members confine the volumetric space, and thus the space for the air flow, between the acquired sheet and the subsequent sheets to increase the pressure on the stack beneath the acquired sheet. The increased pressure provides a significant friction force on the sheets in the sheet stack sufficient to counter the force of the positive air flow urging the sheets in the direction opposite to the feed direction. At the same time, the weighted members 92*a,* 92*b* will enable the acquired sheet to assume the desired corrugated shape and allow the positive air flow to pass through the sheet stack and out through the rear stop 62. As a result, individual sheets will be prevented from moving in the direction opposite to the feed direction, while the effectiveness of the positive air flow for sheet separation will not be negatively impacted.

As noted, it is important to accurately control the level of the topmost sheet in the sheet stack on the supporting platform 14 to ensure proper acquisition of the topmost sheet by the sheet feed head assembly 30. In order to accomplish such control, according to this invention, a control mechanism 100 is provided, such control mechanism including a plurality of sensors 110 and 112*a,* 112*b.* The sheet stack sensor 110 is an analog sensor (for example a photovoltaic cell and LED combination), which is associated with one of the weighted members (92*a*) acting on the top of the sheet stack on the platform 14. Upon elevation of the platform by the lifting mechanism L, as the sheet stack is raised, the arm 94*a* of the weighted member rotates as the weighted member is lifted by the sheet stack. An interrupter flag 96 is attached to, or formed as part of, the arm 94*a.* The flag 96 substantially linearly decreases the radiation from the LED on the photovoltaic cell as the sheet stack is raised and the arm is rotated. The sensor 110 is selected such that the photovoltaic cell has sufficient sensing area to produce an analog signal that represents the position of the top of the sheet stack while the topmost sheet of the stack is in an incremental advance operating window section of travel for the platform 14. The weighted members 92*a,* 92*b* maintain engagement with the top of the sheet stack S with sufficient accuracy to enable the platform to be incrementally moved by the lifting mechanism L to increment the top of the stack with the desired accuracy to maintain proper feeding relationship of the sheets from the stack to the sheet feed head assembly 30. As can be seen in FIG. 7, the fluffing action of the feed head assembly 30 has little effect on the weighted members 92*a,* 92*b.*

As noted above, the plates 80 enable the opposed marginal edges of the sheet stack S to be detected when the sheet stack has been elevated to an operative level relative to the sheet feed head assembly 30. The dimension of the plates 80, in the cross-track direction, is selected to enable the respective plates to detect the opposed marginal edges of sheet stacks with a cross-track dimension less than the overall cross-track dimension of the plates, without compromising the corrugation of the topmost sheet of the stack provided by the plates. Moreover, the plates 80 are associated with respective sensors 112*a,* 112*b* which detect respective opposed marginal edges of the sheet stack S supported on the platform 14.

It is well known that the opposed marginal edges of the sheet stack may vary in flatness (i.e., may be uneven due for example to sheet curl or build up of one of the edges of the stack). It is important for reliable feeding of sheets from the platform 14 by the sheet feed head assembly 30 that flatness variations be taken into account. According to this invention, when the sheet stack S on the platform 14 is first elevated to the operating window section of platform travel by the lifting mechanism L under the control of the mechanism 100, the signal from the sensors 112*a,* 112*b* is provided indicating the detection of the stack opposed marginal edges. At such time, the particular analog signal from the sensor 110 is collected. The collected analog signal is saved and used as a reference value in conjunction with the sheet stack incremental advancement. Thus, the analog reference signal value from the sensor 110 can be thought of as representing the amount of variation in flatness in the marginal edges of the sheet stack. The sensing of sheet edge flatness is also required to assure that the sheets on the stack are not overdriven by the lifting mechanism L into the feed head assembly 30 and cause unreliable feeding.

With the described arrangement, the sensors 110 and 112*a,* 112*b,* may be used to serve multiple purposes. Particularly, the sensors may be used to establish the lower limit for the operating window of incremental advance for the stack supporting platform 14, indicate the need for incremental advance of the stack supporting platform (substantially irrespective of sheet flatness variation in the stack), determine when the last sheet in a sheet stack supported on the platform has been fed, and determine the upper limit for the operating window of incremental advance.

In order to provide the multiple functions, under control of the mechanism 100 and upon initial elevation of the platform 14 by the lifting mechanism L with a particular sheet stack on the platform, the analog signal value from the sheet stack sensor 110 is determined when the top of such stack first actuates one (or both) marginal edge sensors 112*a,* 112*b.* As noted above, this value is collected and stored by the control mechanism 100 and used as the sheet level control signal reference value to establish the lower limit for the incremental advance operating window section of platform travel for such sheet stack. All incremental advance of the sheet stack supporting platform 14 will then be controlled to maintain the top of this particular sheet stack at a level which will yield an analog signal value of a magnitude substantially equal to this reference value. That is, as sheets are fed seriatim from the stack by the sheet feed head assembly 30, at some point the level of the top of the sheet stack will drop below the desired operating window (reliable sheet feeding can no longer be assured). At such time, the analog sensor 110 will produce a signal indicative of a low stack height, or one or both of the marginal edge sensors 112*a,* 112*b* will no longer detect the sheet stack marginal edges. A signal will then be produced and sent to the motor M of the lifting mechanism L to turn on the motor to elevate the platform 14 a sufficient amount until the analog signal from the sensor 110 is again at a magnitude substantially equal to the reference value, indicating that the top level of the sheet stack has returned to at least the lower limit of the operating window. If the motor M overdrives the platform 14 in the elevation direction, the sensor 110 will produce a signal which is below a predetermined level at the time the sensors 112*a,* 112*b* detect the marginal edges of the sheet stack. This condition will cause the motor M to be turned off, or reversed, before damage to the sheet feed head assembly 30 can occur. It is also noted that a signal provided by the sensor 110 on detection of sheet acquisition can be utilized to control operation of various components of the sheet feed head assembly 30, such as timing of activations or setting of air flow levels, to optimize operation for a particular type (size) of sheet to be fed.

It is expected that sheet flatness will remain substantially constant, or increase (i.e., the unevenness will decrease), as sheets are fed from the sheet stack S. Incremental advance will be enabled as described if sheet flatness at either opposed marginal edge remains constant, or increases, as sheets are fed from the sheet stack. That is, when sensors 112*a,* 112*b* no longer detect the edges of the sheet stack S (i.e., as sheets are fed from the stack, the level of the topmost sheet in the stack no longer activates such sensor), a signal is produced which turns on the motor M of the lifting mechanism L for a time to enable the platform to be elevated a distance sufficient to locate the topmost sheet in the stack to again be detected by the sensors 112*a,* 112*b.* This will assure proper sheet stack position, even as the amount of sheet flatness increases as sheets are fed from the sheet stack S.

Further, the sensors 110 and 112*a,* 112*b* can be used to determine if the overall amount of flatness variation of the marginal edges of a particular sheet stack on the platform 14 is too great for reliable feeding of the sheets by the sheet feed head assembly 30 from such stack. This is accomplished by evaluating the analog signal from the sensor 110 and determining whether the signal received from such sensor is above a predetermined maximum threshold value. The threshold value corresponds to the maximum sheet flatness variation which can be reliably fed by the sheet feed head assembly 30. Of course, a particular value for flatness variation, is dependent upon many physical factors of the total system including, but not limited to, sheet size and weight and feed head assembly air flow levels. Once such factors are known, the value is readily ascertainable. When the sheet stack supporting platform 14 is first elevated to the operating position and sensors 112*a,* 112*b* detect the marginal edges of the sheet stack, before sheet feeding starts, the value of the analog signal from the sensor 110 is compared with the threshold value. If the analog signal value is above the threshold value, the variation in flatness in the sheet stack is determined to be too large to allow for reliable sheet feeding. Accordingly, operation of the reproduction apparatus is inhibited and an appropriate warning signal is relayed.

The analog signal from the sensor 110 can also be used to determine when the last sheet in a stack on the platform 14 has been fed away from the platform. To accomplish this purpose, an opening is provided in the platform 14 in juxtaposition with the area where the weighted member 92*a* would ordinarily contact the platform without a sheet present thereon. Accordingly, when the last sheet is fed from the platform, the weighted member 92*a,* and the associated flag 96, will drop below the level of the platform. This results in a rapid, large change in the analog signal from the sensor 110. The control mechanism 100 is set to recognize a rapid, large signal change as representing when the last sheet has been fed from the sheet stack on the platform. Thus, when such signal change is received, the control mechanism determines that the last sheet has been fed and sends a signal to the motor M of the lifting mechanism L to lower the platform to the location where a new stack of sheets can be loaded on the platform.

The invention has been described in detail with particular reference to preferred embodiments thereof, but it will be understood that variations and modifications can be effected within the spirit and scope of the invention as set forth in the claims.

What is claimed is:

1. A sheet feeder having a platform for supporting a stack of sheets, a feed head assembly for feeding sheets seriatim from the top of a sheet supply stack on said platform, means for moving said platform relative to said feed head assembly, and means for controlling operation of said platform moving means, said control means comprising:

means for detecting marginal edges of sheets in the sheet supply stack on said platform, and producing a signal indicative of such sheet edge detection;

means for detecting the location of the top of the sheet supply stack on said platform, and producing a signal indicative of such top sheet location detection;

means for setting a signal representative of the top of said sheet stack being in proper operative relation to said feed head assembly, said signal being based on said signal from said top location sensing means for the particular location of the top of said stack taken when said marginal edge detection signal is first produced; and means for periodically producing a control signal for actuating said platform moving means until said signal from said top location sensing means is substantially equal to said signal set by said signal setting means to establish a predetermined limit to accommodate variations in sheet flatness.

2. The control means for the platform moving means of claim 1 wherein said actuating control signal is produced when said marginal edge detecting means no longer detects marginal edges of the sheet supply stack.

3. The control means for the platform moving means of claim 1 wherein said control signal is produced when said signal indicative of top sheet location detection indicates that such top level is below a predetermined level relative to said feed head assembly.

4. The control means for the platform moving means of claim 1 wherein said actuating control signal is produced when said marginal edge detecting means no longer detects marginal edges of the sheet supply stack, or when said signal indicative of top sheet location detection indicates that such top level is below a predetermined level relative to said feed head assembly.

5. The control means for the platform moving means of claim 1 wherein said marginal edge detecting means includes a pair of sensors for respectively detecting opposed marginal edges of said sheet stack, such edges being parallel to the direction of sheet feed from said stack.

6. The control means for the platform moving means of claim 5 wherein said sensors of said marginal edge detecting means include plates pivotably attached to said feed head assembly so as to be engaged by respective opposed marginal edges of the sheet stack on said platform.

7. The control means for the platform moving means of claim 6 wherein said sensors of said marginal edge detecting means further include means for detecting when said respective pivotable plates are engaged by marginal edges of said sheet stack, and producing a signal indicative thereof.

8. The control means for the platform moving means of claim 7 wherein said marginal edge detecting means further includes means for resiliently urging said pivotable plates in a direction toward said platform and a sheet stack supported thereon to accommodate for overtravel of said platform.

9. The control means for the platform moving means of claim 5 wherein said actuating signal is produced when at least one of said marginal edge detecting sensors no longer detects marginal edges of the sheet supply stack.

10. The control means for the platform moving means of claim 1 wherein said top sheet location detecting means includes an analog sensor which produces a signal which has a value corresponding to the location of the topmost sheet relative to said feed head assembly.

11. The control means for the platform moving means of claim 10 wherein said signal setting means includes means for collecting, and storing said signal from said analog sensor as a reference signal, when said marginal edge detection signal is first produced.

12. The control means for the platform moving means of claim 1 wherein said top location detecting means includes means for detecting the feed of the last sheet in the sheet stack.

13. The control means for the platform moving means of claim 1 including means for determining if a sheet stack on said platform is above a predetermined upper limit which would be too high to reliably feed a sheet from said sheet stack by said feed head assembly.

14. The control means for the platform moving means of claim 13 wherein said predetermined limit used by said stack height upper limit determining means is established as being when said signal from said top location detecting means indicates that the top location is above a preset level at a time when a sheet edge detection signal is produced by said means for detecting marginal edges of sheets in the sheet supply stack on said platform.

15. An apparatus for feeding sheets seriatim from the top of a sheet supply stack, said apparatus including means for supporting a sheet supply stack, a sheet feed head assembly having means for acquiring a sheets from the sheet supply stack and urging acquired sheets seriatim in a direction away from the sheet supply stack, means for directing a flow of air at the sheet supply stack to levitate the top sheets in such stack to an elevation enabling the topmost sheet to be acquired by said sheet feed head assembly and separate any additional sheets adhering to such topmost sheet, a motor in operative association with said sheet stack supporting means for selectively moving said sheet stack supporting means so as to maintain the topmost sheet in such stack at a predetermined level in spaced relation with respect to said acquiring and urging means of said sheet feed head assembly, and means for controlling said motor for said sheet stack supporting means, said control means comprising:

sensors for respectively detecting opposed marginal edges of said sheet stack, such edges being parallel to the direction of sheet feed from said stack, said sensors including plates pivotably attached to said feed head assembly so as to be engaged by respective opposed marginal edges of the sheet stack on said platform, and means for detecting when said respective pivotable plates are engaged by said marginal edges of said sheet stack, and producing a signal indicative thereof;

an analog sensor which produces a signal which has a value corresponding to the location of the topmost sheet of the sheet supply stack on said sheet stack supporting means relative to said feed head assembly;

means for setting a signal representative of the top of said sheet stack being in proper operative relation to said sheet feed head assembly, said signal being based on the signal from said top location analog sensor for the particular location of the top of said stack taken when a signal indicating engagement of a marginal edge with a pivotable plate is first produced; and means for periodically producing a signal for actuating said sheet stack supporting means moving means until said signal from said top location analog sensor is substantially equal to said signal set by said signal setting means to establish a predetermined limit to accommodate variations in sheet flatness.

16. The control means for said motor for said sheet stack supporting means of claim 15 wherein said pivotable plates of said marginal edge sensors are shaped so as to aid in configuration of the topmost sheet for reliable feeding of such sheet.

17. The control means for said motor for said sheet stack supporting means of claim 16 wherein the cross-track dimension of said plates is selected to enable the respective plates to be engaged by the opposed marginal edges of sheet stacks with a cross-track dimension less than the overall cross-track dimension of said plates, without compromising the corrugation of the topmost sheet of the stack provided by said plates.

18. The control means for said motor for said sheet stack supporting means of claim 15 wherein said marginal edge detecting sensors further include means for resiliently urging said pivotable plates in a direction toward said platform and a sheet stack supported thereon to accommodate for over travel of said platform.

19. The control means for said motor for said sheet stack supporting means of claim 15 wherein said actuating signal is produced when at least one of said marginal edge detecting sensors no longer detects marginal edges of the sheet supply stack.

20. The control means for said motor for said sheet stack supporting means of claim 15 wherein said signal setting means includes means for collecting, and storing said signal from said analog sensor as a reference signal, when said signal indicating engagement of a marginal edge with a pivotable plate is first produced.

21. The control means for said motor for said sheet stack supporting means of claim 15 wherein said top location analog sensor includes means for detecting the feed of the last sheet in the sheet stack.

22. A sheet feeder having a platform for supporting a stack of sheets, a feed head assembly for feeding sheets seriatim from the top of a sheet supply stack on said platform, means for moving said platform relative to said feed head assembly, and means for controlling operation of said platform moving means, said control means comprising:

means for detecting marginal edges of sheets in the sheet supply stack on said platform, and producing a signal indicative of such sheet edge detection;

an analog sensor for detecting the location of the top of the sheet supply stack on said platform, and producing a signal indicative of such top sheet location detection having a value corresponding to the location of the topmost sheet relative to said feed head assembly;

means for setting a signal representative of the top of said sheet stack being in proper operative relation to said feed head assembly, said signal setting means including means for collecting, and storing said signal from said analog sensor as a reference signal when said marginal edge detection signal is first produced, said signal being based on said signal from said top location sensing means for the particular location of the top of said stack taken when said marginal edge detection signal is first produced;

means for determining if the flatness variation of the marginal edges is above a predetermined limit which would be too large to reliably feed a sheet from said sheet stack, said predetermined limit used by said flatness variation determining means established as being when said signal from said top location detecting means indicates that the top location is below a preset level at a time when said sheet edge detection signal is produced; and means for periodically producing a control signal for actuating said platform moving means until said signal from said top location sensing means is substantially equal to said signal set by said signal setting means.

23. An apparatus for feeding sheets seriatim from the top of a sheet supply stack, said apparatus including means for supporting a sheet supply stack, a sheet feed head assembly having means for acquiring a sheets from the sheet supply stack and urging acquired sheets seriatim in a direction away from the sheet supply stack, means for directing a flow of air at the sheet supply stack to levitate the top sheets in such stack to an elevation enabling the topmost sheet to be acquired by said sheet feed head assembly and separate any additional sheets adhering to such topmost sheet, a motor in operative association with said sheet stack supporting means for selectively moving said sheet stack supporting means so as to maintain the topmost sheet in such stack at a predetermined level in spaced relation with respect to said acquiring and urging means of said sheet feed head assembly, and means for controlling said motor for said sheet stack supporting means, said control means comprising:

sensors for respectively detecting opposed marginal edges of said sheet stack, such edges being parallel to the direction of sheet feed from said stack, said sensors including plates pivotably attached to said feed head assembly so as to be engaged by respective opposed marginal edges of the sheet stack on said platform, and means for detecting when said respective pivotable plates are engaged by said marginal edges of said sheet stack, and producing a signal indicative thereof;

an analog sensor which produces a signal which has a value corresponding to the location of the topmost sheet of the sheet supply stack on said sheet stack supporting means relative to said feed head assembly;

means for setting a signal representative of the top of said sheet stack being in proper operative relation to said sheet feed head assembly, said signal being based on the signal from said top location analog sensor for the particular location of the top of said stack taken when a signal indicating engagement of a marginal edge with a pivotable plate is first produced;

means for determining if the flatness variation of the marginal edges is above a predetermined limit which would be too large to reliably feed a sheet from said sheet stack wherein said predetermined limit used by said flatness variation determining means is established as being when said signal from said top location analog sensor indicates that the top location is below a preset level at a time when a signal indicating engagement of a marginal edge with a pivotable plate is produced; and means for periodically producing a signal for actuating said sheet stack supporting means moving means until said signal from said top location analog sensor is substantially equal to said signal set by said signal setting means.

24. An apparatus for feeding sheets seriatim from the top of a sheet supply stack, said apparatus including means for supporting a sheet supply stack, a sheet feed head assembly having means for acquiring a sheets from the sheet supply stack and urging acquired sheets seriatim in a direction away from the sheet supply stack, means for directing a flow of air at the sheet supply stack to levitate the top sheets in such stack to an elevation enabling the topmost sheet to be acquired by said sheet feed head assembly and separate any additional sheets adhering to such topmost sheet, a motor in operative association with said sheet stack supporting means for selectively moving said sheet stack supporting means so as to maintain the topmost sheet in such stack at a predetermined level in spaced relation with respect to said acquiring and urging means of said sheet feed head assembly, and means for controlling said motor for said sheet stack supporting means, said control means comprising:

sensors for respectively detecting opposed marginal edges of said sheet stack, such edges being parallel to the direction of sheet feed from said stack, said sensors including plates pivotably attached to said feed head assembly so as to be engaged by respective opposed marginal edges of the sheet stack on said platform, and means for detecting when said respective pivotable plates are engaged by said marginal edges of said sheet stack, and producing a signal indicative thereof;

an analog sensor which produces a signal which has a value corresponding to the location of the topmost sheet of the sheet supply stack on said sheet stack supporting means relative to said feed head assembly;

means for setting a signal representative of the top of said sheet stack being in proper operative relation to said sheet feed head assembly, said signal being based on the signal from said top location analog sensor for the particular location of the top of said stack taken when a signal indicating engagement of a marginal edge with a pivotable plate is first produced;

means for determining if a sheet stack on said platform is above a predetermined upper limit which would be too high to reliably feed a sheet from said sheet stack by said sheet feed head assembly, said predetermined limit used by said stack height upper limit determining means is established as being when said signal from said top location analog sensor indicates that the top location is above a preset level at a time when a signal indicating engagement of a marginal edge with a pivotable plate is produced; and means for periodically producing a signal for actuating said sheet stack supporting means moving means until said signal from said top location analog sensor is substantially equal to said signal set by said signal setting means.

* * * * *